US005915629A

United States Patent [19]

Ribeiro

[11] Patent Number: 5,915,629

[45] Date of Patent: Jun. 29, 1999

[54] SECURITY FASTENING CONNECTION FOR PACKETS AND OTHER USES

[76] Inventor: Mario Fernandes Ribeiro, San Martin 686, 7°piso of. 72 - 1004 Buenos Aires, Argentina

[21] Appl. No.: 09/014,623

[22] Filed: Jan. 28, 1998

[51] Int. Cl.[6] ..... B65D 63/00

[52] U.S. Cl. ..... 24/16 R; 24/17 R; 24/18

[58] Field of Search ..... 24/16 R, 17 R, 24/17 AP, 18, 129 A

[56] References Cited

U.S. PATENT DOCUMENTS

| | | | |
|---|---|---|---|
| 1,038,785 | 9/1912 | Parks | 24/18 |
| 1,275,130 | 8/1918 | Carlson | 24/18 |
| 1,349,857 | 8/1920 | Salop | 24/17 R |
| 1,617,556 | 2/1927 | Vineberg | 24/17 R |
| 3,286,313 | 11/1966 | Beghetto, Jr. | 24/16 R |
| 3,414,943 | 12/1968 | Hattori | 24/16 R |
| 4,648,159 | 3/1987 | Dougherty | 24/18 |
| 5,195,216 | 3/1993 | Ishii | 24/18 |
| 5,426,829 | 6/1995 | Hsiung | 24/16 R |

FOREIGN PATENT DOCUMENTS

| | | | |
|---|---|---|---|
| 0971779 | 1/1951 | France | 24/16 R |
| 0288061 | 8/1931 | Italy | 24/16 R |
| 5305961 | 11/1993 | Japan | 24/16 R |
| 0280656 | 11/1927 | United Kingdom | 24/18 |

*Primary Examiner*—Victor N. Sakran
*Attorney, Agent, or Firm*—Staas & Halsey

[57] ABSTRACT

Security fastening connection for packets and other uses, destined to the joining of the ends of fastening means such as ropes, perforated tapes, dented tapes or similar being applied to packets constituted by postal packages, luggage or boxes; includes a) a main body provided with a central cavity which is exposed through at least one inlet mouth that affects one of the main faces of said main body; and b) at least two passages for fastening means, said passages having retentive admission means for dented tapes going through said main body in a way such that they coincide in said central cavity. The device further includes c) at least one salient, disposed within said central cavity, and which constitutes a fastening means for perforated tapes; and d) a blocking lid of said inlet mouth that, provided by unremovable connection means with said main body, conforms the support of the identifying security means.

7 Claims, 3 Drawing Sheets

SECURITY FASTENING CONNECTION FOR PACKETS AND OTHER USES

BACKGROUND OF THE INVENTION

1. Field of the Invention

The present patent is related to a security fastening connection for packets and other uses that allows the tying of packets with the fixing of identifying security means that allow the control of the misappropriation of the packets.

2. Related Art

Numerous elements destined to the fixing of the fastening means are known, with which packets such as packing of different shapes and sizes such as postal packages, satchels and suitcases, etc. among the elements the most traditional can be found such as a set of complementary metallic plates which, disposed one opposite the other, are coupled in such a way that they are unremovable by means of deformation through an adequate tool. These plates have various limitations among which one can highlight that a defective coupling leads to slackness, due to which frequently one must recur to interpose complementary elements such as pieces of cardboard. Furthermore, this type of elements are only apt for its application to tying ropes as their sharp-edged metallic couplings cut the fastening means such as plastic tape.

Another securing means for fasteners is known, the same consisting in a piece in the form of a cross which can be deformable that can be applied to the intercrossing of the tying of tapes. This deformable piece has four arms that, encircling the respective ends of the tapes, are fixed by means of deforming compression. The application is completed with a rope binding, each going across perforations of the piece and the intercrossed tapes.

That is to say, it is a piece mainly applicable to plain tapes with even faces, and that, on one part, requires of the mentioned binding rope, while, on the other part, it needs appropriate tools for its collocation as well as for its binding.

SUMMARY OF THE INVENTION

The present fastening connection is apt not only for traditional fastening means, but also for plastic tapes with dented edges, of dented or perforated faces. This is so due to the fact that its main body has passages provided of retentive admission devices and fastening salients. Notwithstanding the same, the inclusion of complementary fastening means or conformed by its blocking lid enables its application to fastenings of plane tapes or ropes.

The present tying connection is much more simple to collocate and it is not necessary to use specific application tools. In effect, one only needs to insert the ends of the tapes through the corresponding admission passages and then to pull until one achieves the fastening of the packet. In the case of perforated tapes, the perforations are inserted by their ends in the fastening salient.

On the other hand, the inclusion of a blocking lid of the inlet mouth to the central cavity, provides the appropriate support on which the identifying security means are arranged, such as bar codes or microchips emitting identifiable signals.

In this way, not only does one firmly secure the closing of any type of packets such as small postal packages and attachés, as well as bigger units such as boxes, chests and suitcases.

Particularly in the case of postal packages and suitcases included in luggage traveling in a different compartment i.e., the baggage compartment, than that of the traveler carrying them, as in the case of trains, long distance buses or ships and planes, the inconveniences affecting this luggage is very frequent. Thus, the luggage gets lost, erroneous interchange of baggage, misappropriation, robbery, involuntary introduction of smuggled goods, drugs, etc.

The unremovable closure of the blocking lid against the main body and the fixing of same to the mentioned identifying security means issued by the corresponding authorities or by the transporting company, shall prevent all the mentioned drawbacks.

To the specified ends the security fastening connection a) for packets c) and other uses, destined to the joining of the ends of fastening means b) such as ropes 10), perforated tapes 12), dented tapes 9) 11) or similar being applied to packets c) constituted by postal packages, luggage 14) 15) or boxes 13); includes:

a) a main body 1) provided with a central cavity 3) which is exposed through at least one inlet mouth 2) that affects one of the main faces 1') of the main body 1);

b) at least two passages 4) for fastening means b), the passages 4) having retentive admission means 4') of dented tapes 9) 11) going through the main body 1) in a way that they coincide in the central cavity 3);

c) at least one salient 5), which, disposed within said central cavity 3), constitutes a fastening device for perforated tapes 12); and d) a blocking lid 6) of said inlet mouth 2) that, provided by removable connection means 7)7') with said main body 1), conforms the support of the identifying security device 8).

BRIEF DESCRIPTION OF THE DRAWINGS

The object of the invention has been illustrated for better clarity and understanding of the same. It is illustrated with various figures in which its has been represented in one of its preferred embodiments, all this as an illustrative, not limiting example.

In the different figures the same reference numbers indicate same or corresponding parts, the sets of various elements being indicated with letters.

DESCRIPTION OF THE PREFERRED EMBODIMENTS

Figure 1:
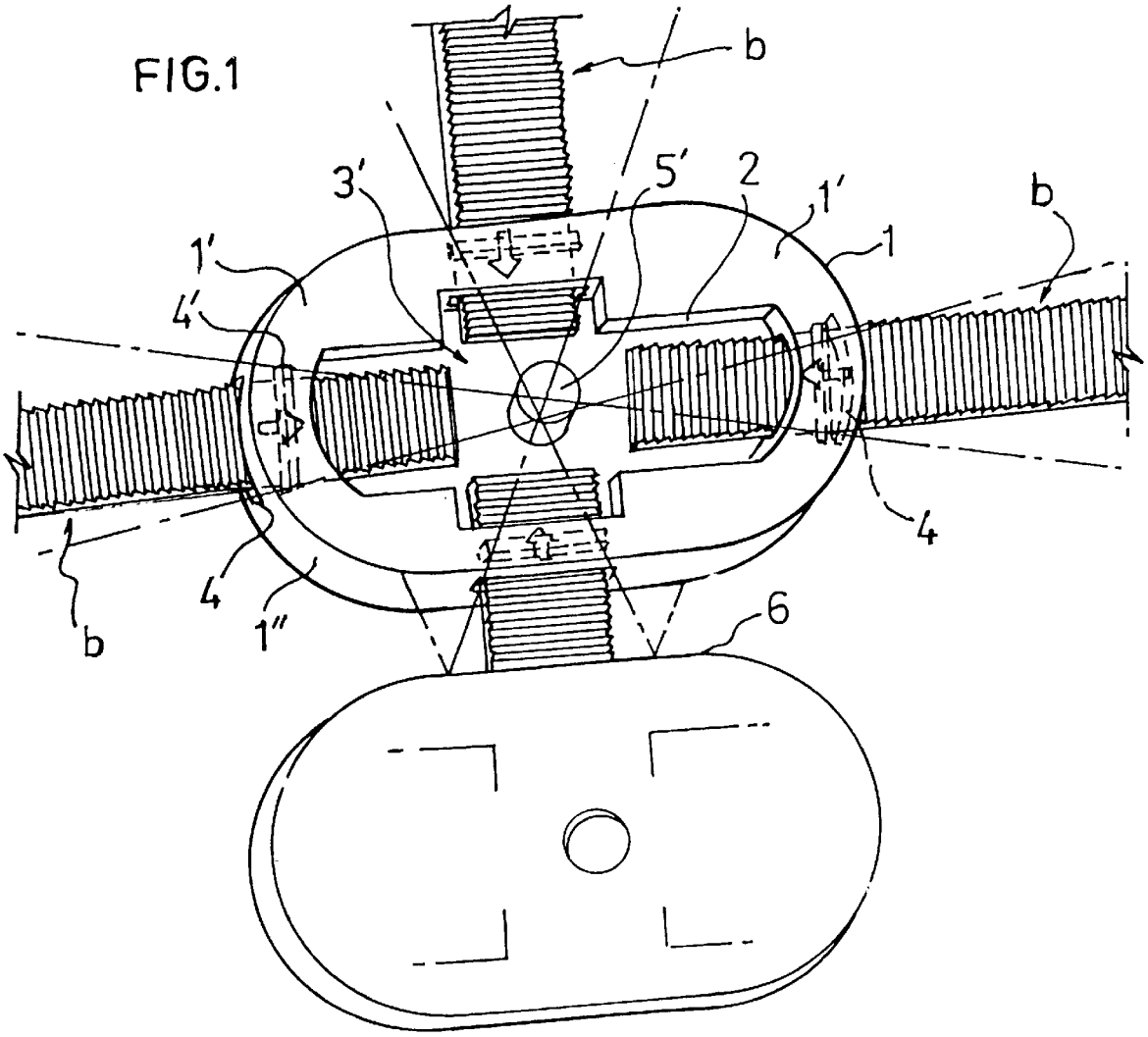
FIG. 1 is a view in perspective of the present security fastening connection in which its general conformation can be observed, as well as the insertion of the ends of the tapes with the dented face through the respective passages.
Figure 3:
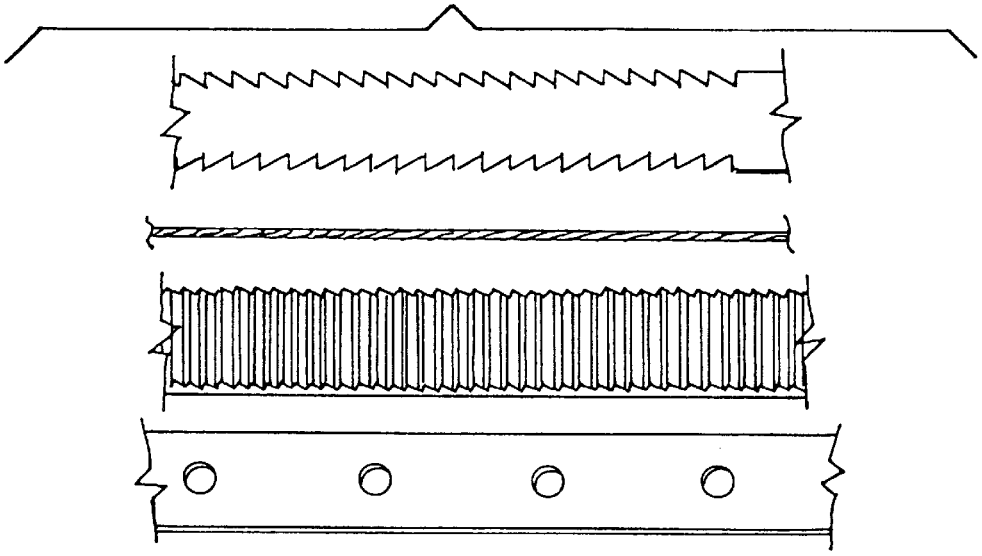
FIG. 3 is a top view in which different fastening means applicable to the present fastening connection are illustrated. A tape with dented edges, a rope, a tape with dented faces and a perforated tape can be seen.

In general terms the present invention is in a security fastening connection a) for packets c) and other uses that includes a main body 1) with an open central cavity 3) in which passages 4) coincide, destined to corresponding fastening means b), including retentive admission means 4') of dented tapes 9)11) and a fastening salient 5) of perforated tapes 12), as well as a blocking lid 6) that is used as a support to the identifying security device 8). [see FIG. 4].

It is a fastening connection a) destined to the joining of the ends of the fastening media b) such as ropes 10), tapes with dented edges 9), tapes with dented faces 11) and perforated tapes 12). These fastening media b) are applicable to different packets c) constituted by packages, postal packages 13), or luggage such as attaches 15) and suitcases 14). [see FIGS. 3–4A–4B–4C]

More particularly, the present fastening connection a) is composed by a main body 1) that, although it can have different conformations -round, oval, in the shape of a cross, rectangular-, in all the cases is provided with a central cavity 3) exposed by means of an inlet mouth 2), which affects one of the main faces 1') of said main body 1). [see FIG. 1]

Figure 2A:
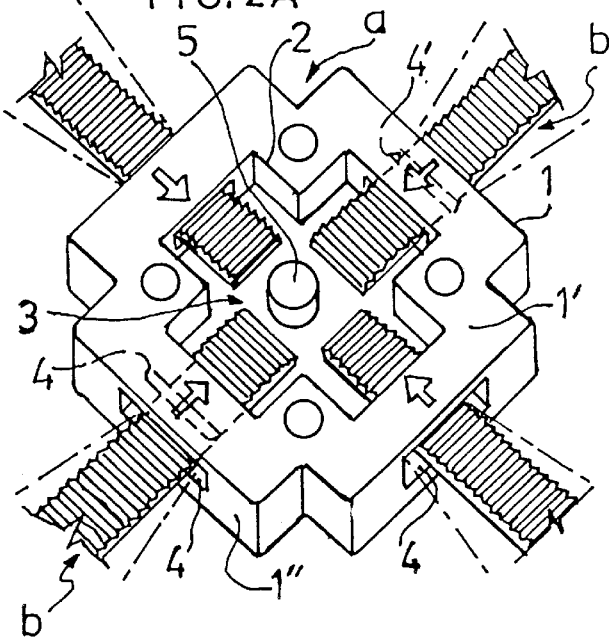
FIG. 2A is a view in perspective of one embodiment in which the main body has four passages and a configuration in the form of a cross.
Figure 2B:
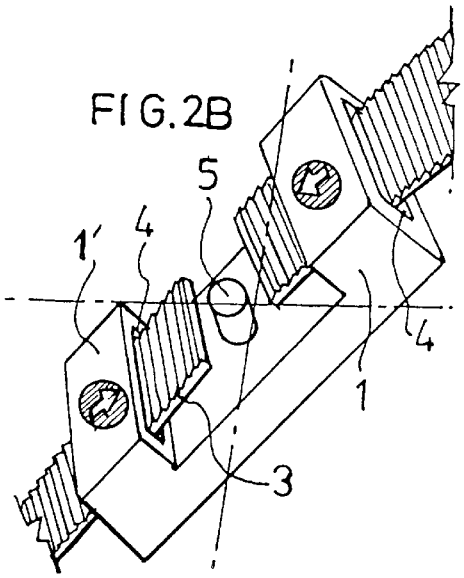
FIG. 2B is a view in perspective of another embodiment in which the main body has a rectangular conformation and two inlet passages for the tapes.
Figure 2C:
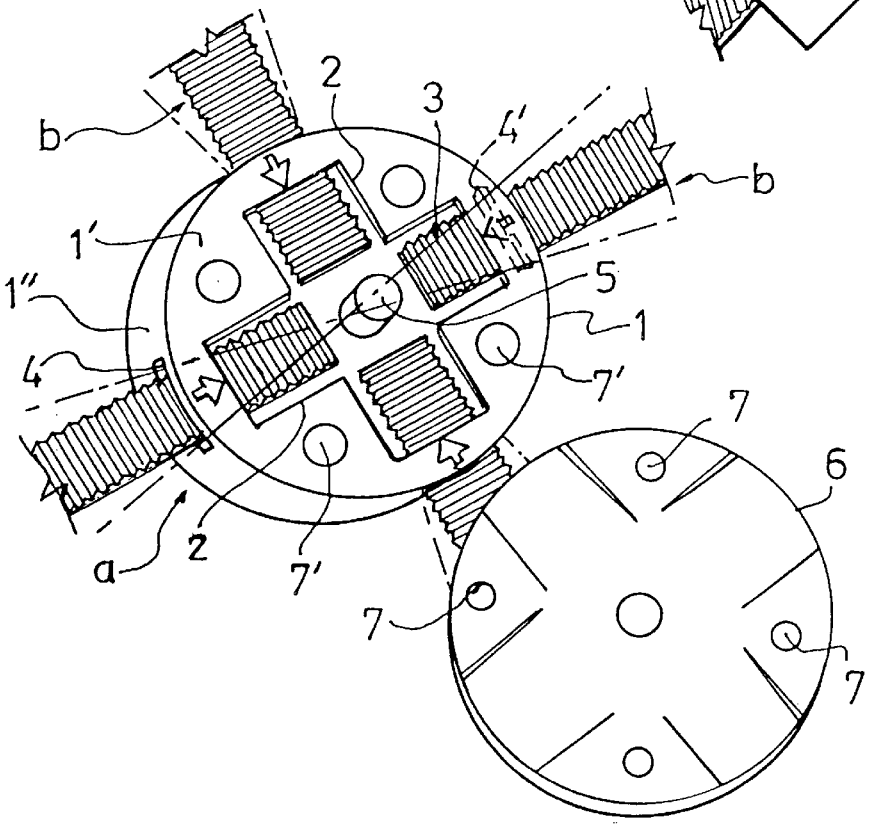
FIG. 2C is a view in perspective of another embodiment in which the main body as well as its blocking lid have a circular conformation.

Also, this main body 1) is run through by passages 4), which, being destined to corresponding fastening means b), have an origin in the lateral edges 1") and end in the central cavity 3 towards which they coincide. Although the fastening connection a) must contain at least two passages 4), in one preferred embodiment it has four passages 4) coincidentally disposed in the form of a cross. These passages 4) have retentive admission means 4') for dented tapes 9)11). [see FIGS. 2A–2B–2C]

At the bottom of the central cavity 3) there is a salient 5) that constitutes a fastening means connectable to perforated tapes 12). In different embodiments, this salient 5) may be conformed by the main body 1) itself or consist on a small key that can be fixed to the bottom of the central cavity 3). [see FIGS. 1–2A–2B–2C]

On the other part, the connection a) has a blocking lid 6) of the inlet mouth 2) to said central cavity 3). In the embodiment being described, this blocking lid 6) is provided with males means 7) of unremovable union which are connectable with corresponding female means 7') conformed on the main face 1') of the body of the fastening connection a). [see FIGS. 1–2C]

This blocking lid 6) may present variations like the conformation of fastening means for tying ropes 10) or the inclusion of a complementary fastener that compresses said ropes 10) against the main body 1).

Figure 4A:
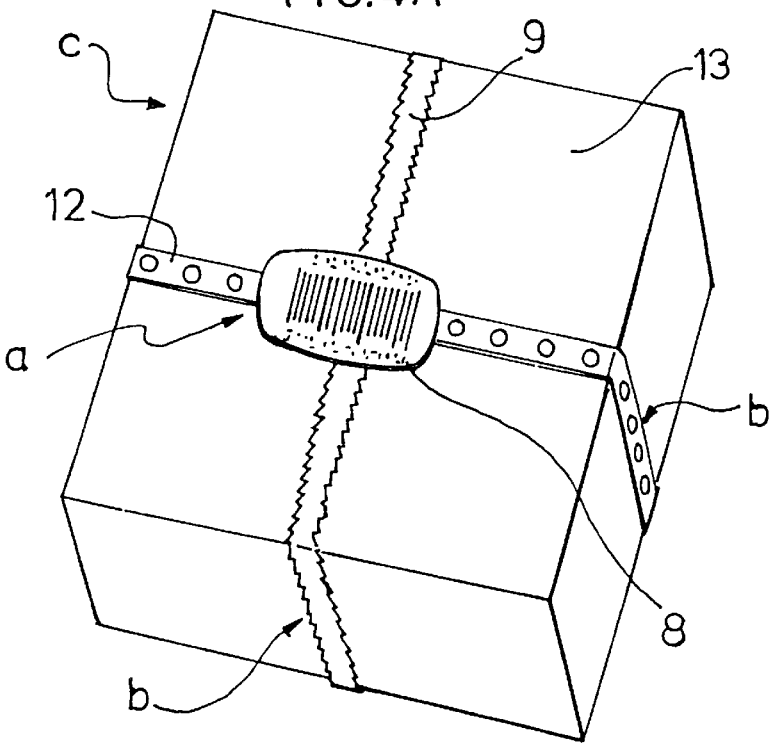
FIG. 4A is a view in perspective of a packet in which the connection has a mixed fastening integrated by perforated tapes and tapes with dented edges.
Figure 4C:
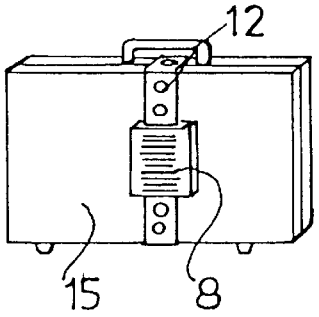
FIG. 4C is a view in perspective of an attaché) its lock being secured with a perforated tape.
Figure 4B:
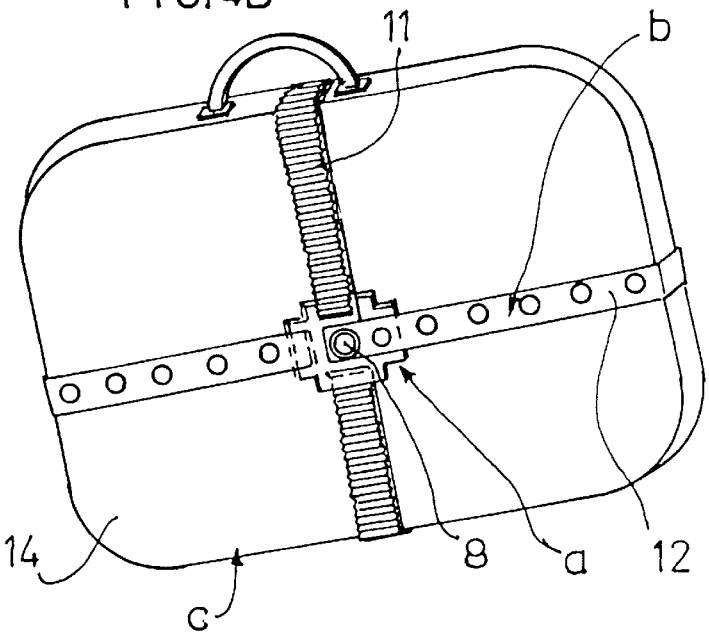
FIG. 4B is a view in perspective of a suitcase tied with tapes with dented faces and perforated tapes.

Together with this, said blocking lid 6) may be used as a support for the identifying security means 8) such as bar codes and microchips. [see FIGS. 4A–4C]

The set functions in the following way

For the application of the present fastening connection a), the fastening media b) such as ropes 10) or tapes 9)11)12) that encircle in an embracing manner packets c) such as postal packages 13), attachés 15) or suitcases 14) must be previously applied. [see FIGS. 44–4B–4C]

The fastening connection a) is disposed in the area of intercrossing of the fastening media b). The ends of the latter b) are introduced through the respective passages 4) and are tensed in order to fix the tying.

In the case of the tapes with dented edges 9) and dented faces 11), their respective dents 9')11') result in being retained by the retentive admission means 4') conformed in the interior part of the passages 4). [see FIGS. 1–2A–2B–2C]

As at the bottom of the central cavity 3) the fastening salient 5) can be found, the perforations 12') of the perforated tapes 12) can be inserted over the same.

The presence of the retentive admission means 4') and of the fastening salient 5) allow the combined use of perforated tapes 12) and dented tapes 9)11) for the same packet c). in the embodiments in which the blocking lid 6) disposes of a complementary fastener or according to fastening media such as internal salients, ropes 10) may be employed as fastening means b).

Once the blocking lid 6 is unremovably fixed to the main body 1), through the respective male 7) and female 7') joining means, the presence of the security means 8), such as bar codes or microchips, both of which allow the identification of the application packet c) by the owner. [see FIGS. 4A–4C]

Indubitably, when the present invention is put into practice, modifications concerning details in construction and shape may be introduced, without departing from the fundamental principles that are clearly expressed in the claim clauses that follow hereinafter:

I claim:

1. A security fastening connection for packets and other uses, used for the joining of ends of fastening means such as ropes, perforated tapes, or dented tapes which are applied to packets such as postal packages, luggage or boxes, said security fastening connection includes:

a) a main body having two main faces provided with a central cavity which is exposed through at least one inlet mouth so that said central cavity affects one of the main faces of said main body;

b) at least two passages for said fastening means, said passages having retentive admission means for dented tapes going through said main body in a way that the dented tapes coincide in said central cavity;

c) at least one salient, disposed within said central cavity, which acts as a fastening means for perforated tapes; and d) a blocking lid for said inlet mouth provided with unremovable connection means for connecting with said main body, and which conforms the support of an identifying security means.

2. A security fastening connection for packets and other uses, according to claim 1, wherein the main body includes four passages for fastening means, said passages ending coincidentally in the central cavity in the form of a cross.

3. A security fastening connection for packets and other uses, according to claim 1, wherein the fastening salient consists of a small key that can be fixed at a bottom of the central cavity.

4. A security fastening connection for packets and other uses, according to claim 1, wherein the identifying security means includes a bar code.

5. A security fastening connection for packets and other uses, according to claim 1, wherein the identifying security means includes a microchip.

6. A security fastening connection for packets and other uses, according to claim 1, wherein the blocking lid includes fastening means for the fastening of ropes against the main body.

7. A security fastening connection for packets and other uses, according to claim 1, wherein the blocking lid includes a complementary fastener for fastening ropes against the main body.

* * * * *